US005625989A

United States Patent [19]

Brubaker et al.

[11] Patent Number: 5,625,989

[45] Date of Patent: May 6, 1997

[54] METHOD AND APPARATUS FOR FORMING OF A POURED CONCRETE WALL

[75] Inventors: Thomas R. Brubaker, Doylestown, Pa.; Thomas Walton, Howell, Mich.

[73] Assignee: Huntington Foam Corp., Brockway, Pa.

[21] Appl. No.: 509,042

[22] Filed: Jul. 28, 1995

[51] Int. Cl.[6] ..... E04C 1/00

[52] U.S. Cl. ..... 52/309.12; 52/426; 249/40

[58] Field of Search ..... 249/40, 216, 218, 249/214, 217; 52/426, 285.1, 309.11, 562, 563, 564, 309.12, 309.17

[56] References Cited

U.S. PATENT DOCUMENTS

| | | | |
|---|---|---|---|
| 2,460,532 | 2/1949 | Porter, Jr. . | |
| 2,648,116 | 8/1953 | Macready . | |
| 2,655,710 | 10/1953 | Roensch et al. . | |
| 2,908,063 | 10/1959 | Jones et al. . | |
| 3,148,429 | 9/1964 | Garmon . | |
| 3,357,673 | 12/1967 | Williams . | |
| 3,481,575 | 12/1969 | Arrighini . | |
| 3,549,115 | 12/1970 | Williams . | |
| 3,558,095 | 1/1971 | McNiel . | |
| 3,595,514 | 7/1971 | Sanders . | |
| 3,680,824 | 8/1972 | Kesting . | |
| 3,693,928 | 9/1972 | Shoemaker . | |
| 3,748,806 | 7/1973 | Talandis . | |
| 3,959,940 | 6/1976 | Ramberg . | |
| 4,027,846 | 6/1977 | Caplat . | |
| 4,117,639 | 10/1978 | Steenson et al. . | |
| 4,147,322 | 4/1979 | Dahlstrom . | |
| 4,223,501 | 9/1980 | DeLozier . | |
| 4,226,061 | 10/1980 | Day, Jr. . | |
| 4,229,920 | 10/1980 | Lount . | |
| 4,316,594 | 2/1982 | Schwörer . | |
| 4,333,289 | 6/1982 | Strickland . | |
| 4,348,344 | 9/1982 | Nobbe . | |
| 4,463,926 | 8/1984 | Bomberger . | |
| 4,465,403 | 8/1984 | Schreiber et al. . | |
| 4,506,428 | 3/1985 | Gerhard . | |
| 4,730,422 | 3/1988 | Young . | |
| 4,731,968 | 3/1988 | Obino | 52/564 X |
| 4,884,382 | 12/1989 | Horobin | 52/564 X |
| 4,889,310 | 12/1989 | Boeshart . | |
| 4,916,879 | 4/1990 | Boeshart | 249/40 X |
| 4,944,664 | 7/1990 | Allred . | |
| 4,957,272 | 9/1990 | Lee . | |
| 5,078,360 | 1/1992 | Spera . | |
| 5,209,039 | 5/1993 | Boeshart . | |
| 5,216,860 | 6/1993 | Thomson et al. . | |
| 5,409,193 | 4/1995 | Baxter . | |
| 5,459,971 | 10/1995 | Sparkman | 52/562 X |

*Primary Examiner*—Creighton Smith

[57] ABSTRACT

An improved apparatus for defining a mold to allow the pouring of a concrete wall therein is disclosed along with a method of use thereof wherein two identically configured panel members each define slots therein which receive flanges of a connecting member. The connecting member is designed to be placed into the slots in the panel members at the site of construction thereby allowing shipment of the panel members as well as the connecting members to the construction site collapsed or packaged in a compact manner. The connecting member includes a central spacer mid section which can be configured having various lengths in order to accommodate forming of concrete poured walls of different thicknesses based upon the decision made at the site of construction. The flanges extend vertically preferably completely through the slots in the panels to define vertical attachment surfaces spaced apart at preferably approximately twelve inch intervals to facilitate attachment of items to the panels of the final construction. When unhardened concrete is poured into the space defined between the panels by the distance of the spacer mid-section of the connecting member it forms vertical and horizontal concrete columns when hardened to provide a significantly strengthened wall configuration.

13 Claims, 4 Drawing Sheets

METHOD AND APPARATUS FOR FORMING OF A POURED CONCRETE WALL

BACKGROUND OF THE INVENTION

1. Field of the Invention

The present invention deals with the field of devices for use at construction sites forming buildings and walls generally. More particularly design of the present invention is designed to provide a form for creating vertically standing walls by pouring unhardened concrete therein and allowing the concrete to harden with the mold formed thereafter forming a portion of the final construction. More particularly the design of the present invention pertains to those forms which include spacer members or brackets extending between vertically extending panels for defining space therebetween within which unhardened poured concrete can be placed to form such high strength walls.

Walls formed of poured concrete are particularly adaptable in today's usage in view of the possibility of damage to standing structures especially from natural disasters such as earthquakes, hurricanes, fallen trees, etc. The design of a poured concrete wall provides significant structural strength for use in such applications as well as other areas where extremely stable building construction needs are apparent.

2. Description of the Prior Art

Numerous prior art designs have been contemplated and some utilizes such as those shown in U.S. Pat. No. 2,460,532 issued Feb. 1, 1949 to L. R. Porter, Jr. on a "Mold For Casting Wall Slabs"; and U.S. Pat. No. 2,648,116 issued Aug. 11, 1953 to G. A. Macready on a "Method Of Making Hollow Monolithic Concrete Slabs"; and U.S. Pat. No. 2,655,710 issued Oct. 20, 1953 to B. Roensch et al and assigned to Daystrom, Incorporated on a "Method Of Making Building Panels"; and U.S. Pat. No. 2,908,063 issued Oct. 13, 1959 to H. S. Jones et al on a "Mold For Forming Concrete Frames"; and U.S. Pat. No. 3,148,429 issued Sep. 15, 1964 to T. W. Garmon on a "Form For Casting Concrete Wall Slab"; and U.S. Pat. No. 3,357,673 issued Dec. 12, 1967 to W. D. Williams and assigned to Symons Mfg. Company on a "Concrete Wall Form With A Particular Panel Hinge Arrangement"; and U.S. Pat. No. 3,481,575 issued Dec. 2, 1969 to A. Arrighini and assigned to Rocform Corporation on a "Prefabricated Wall Form"; and U.S. Pat. No. 3,549,115issued Dec. 22, 1970 to F. Williams and assigned to American Cement Corporation on a "Form For Monolithic Concrete Wall Construction"; and U.S. Pat. No. 3,558,095 issued Jan. 26, 1971 to N. McNiel and assigned to Ben D. Marks on a "Building Wall Apparatus"; and U.S. Pat. No. 3,595,514 issued Jul. 27, 1971 to J. Sanders on an "Adjustable Form For Poured Concrete Construction"; and U.S. Pat. No. 3,680,824 issued Aug. 1, 1972 to L. Kesting on an "Apparatus For Manufacture Of Concrete Buildings"; and U.S. Pat. No. 3,693,928 issued Sep. 26, 1972 to J. Shoemaker and assigned to Synions Corporation on a "Concrete Wall Form With Adjustable Bulkhead"; and U.S. Pat. No. 3,748,806 issued Jul. 31, 1973 to V. Talandis on a "Concrete Wall Form"; and U.S. Pat. No. 3,959,940 issued Jun. 1, 1976 to L. Ramberg on a "Reinforcing Assembly And Reinforced Concrete Building Walls"; and U.S. Pat. No. 4,027,846 issued Jun. 7, 1977 to S. Caplat and assigned to Societe Les Coffrages Madernes on a "Panel For Casting Concrete"; and U.S. Pat. No. 4,117,639 issued Oct. 3, 1978 to T. Steenson et al and assigned to Butler Manufacturing Company on a "Reinforced Insulated Concrete Building Panel"; and U.S. Pat. No. 4,147,322 issued Apr. 3, 1979 to C. Dahlstrom on a "Mold Element For Concrete-Casting"; and U.S. Pat. No. 4,223,501 issued Sep. 23, 1980 to H. DeLozier and assigned to Rocky Mountain Foam Form, Inc. on a "Concrete Form"; and U.S. Pat. No. 4,226,061 issued Oct. 7, 1980 to P. Day, Jr. on a "Reinforced Masonry Construction"; and U.S. Pat. No. 4,229,920 issued Oct. 28, 1980 to W. Lount and assigned to Frank R. Lount & Son (1971) Ltd. on a "Foamed Plastic Concrete Form And Connectors Therefor"; and U.S. Pat. No. 4,316,594 issued Feb. 23, 1982 to A. Schworer and assigned to "Peri-Werk Artur-Schworer KG on a "Formwork Panel For Concrete Walls"; and U.S. Pat. No. 4,333,289 issued Jun. 8, 1982 to J. Strickland and assigned to Strickland Systems, Inc. on a "Concrete Form Support Structure"; and U.S. Pat. No. 4,348,344 issued Sep. 7, 1982 to P. Nobbe on a "Method And Device For Producing Slotted Concrete Walls In Place"; and U.S. Pat. No. 4,463,926 issued Aug. 7, 1984 to W. Bomberger and assigned to GIBA AG Gesellschaft fur Industrialisierung in Bauwesen on an "Assembly Of Casing Elements For Pouring Of Concrete"; and U.S. Pat. No. 4,465,403 issued Aug. 14, 1984 to J. Schreiber et al and assigned to Soletanche on a "Method Of Constructing Poured-Concrete Wall Panels And Wall Thus Obtained"; and U.S. Pat. No. 4,506,428 issued Mar. 26, 1985 to R. Gerhard and assigned to Bank Constructors, Inc. on a "Method Of Forming A Prefabricated Concrete Panel"; and U.S. Pat. No. 4,730,422 issued Mar. 15, 1988 to D. Young and assigned to Young Rubber Company on an "Insulating Non-Removable Type Concrete Wall Forming Structure And Device And System For Attaching Wall Coverings Thereto"; and U.S. Pat. No. 4,889,310 issued Dec. 26, 1989 to P. Boeshart on a "Concrete Forming System"; and U.S. Pat. No. 4,944,664 issued Jul. 31, 1990 to C. Allred on a "Concrete Wall Form Apparatus"; and U.S. Pat. No. 4,957,272 issued Sep. 18, 1990 to Y. Lee on a "Modular Concrete Form"; and U.S. Pat. No. 5,078,360 issued Jan. 7, 1992 to V. Spera and assigned to Speral Aluminum Inc. on a "Prefabricated Assembly For Poured Concrete Forming Structures"; and U.S. Pat. No. 5,209,039 issued May 11, 1993 to P. Boeshart on an "Apparatus For Interconnecting Concrete Wall Forms"; and U.S. Pat. No. 5,216,860 issued Jun. 8, 1993 to D. Thomson et al and assigned to Maploca of Illinois, Inc. on a "Building System For Reinforced Concrete Construction"; and U.S. Pat. No. 5,409,193 issued Apr. 25, 1995 to K. Baxter on an "Insulated Concrete Wall Tie System".

SUMMARY OF THE INVENTION

The present invention provides an apparatus for forming of a concrete wall which utilizes a plurality of modular interlocking mold forms which each define a mold therein in such a manner that a wall can be formed by receiving unhardened poured concrete into the molds. The molds include interlocking column sections for providing significant strength in the overall final structure. The mold is designed to form a part of the finally configured wall after the poured concrete has hardened.

Each of the modular interlocking mold forms includes a first panel member formed of a foam polymeric material which defines a first slot extending vertically completely therethrough preferably in a vertical direction. This first slot preferably defines first vertical slots which are positioned approximately twelve inches from one another to provide securement surfaces in the final constructed wall configuration. The first panel member preferably includes a first outer panel side having a first wall surface area extending generally vertically thereon. The first panel member further includes a first inner panel side positioned oppositely from the first outer panel side.

The second panel member is preferably formed with an identical configuration to the first panel member. In fact, the second panel member can and preferably will actually be formed as a general panel member wherein the first and second panel members are completely interchangeable as being of identical construction. In any case by definition the second panel member will be formed of a foam polymeric material defining a second slot extending vertically completely therethrough with at least a portion of the second vertical slots positioned therein with spacing therebetween of approximately twelve inches to provide securement surfaces. The second panel will preferably include a second outer panel side having a second wall surface area extending generally vertically thereon and facing oppositely from the first panel member. The second panel member will also preferably include a second inner panel side positioned oppositely from the second outer panel side and facing the first inner panel side of the first panel member. This first inner panel side and the second inner panel side will define a plurality of vertically extending concrete column mold forms preferably as well as a plurality of horizontally extending concrete mold forms in order to facilitate the formation of a concrete wall of significant strength.

A connecting member is preferably detachably securable with respect to the first panel and the second panel and extends therebetween in such a manner as to maintain spatial distance therebetween for defining a molding chamber therebetween. Several of these connecting members will normally be detachably secured with respect to the first and second panel members. Each of the connecting members will preferably include a first flange which is detachable and is securable extending to a position within the first slot of the first panel. The first flange will preferably extend through the entire length of the first slot in such a manner as to be capable of abutment with a flange of a similarly configured modular interlocking mold form thereabove and/or therebelow. A second flange will preferably be detachably securable extending within the second slot of the second panel member. This second flange will extend through the entire length of the second slot in such a manner as to be capable of abutment with a flange of a similarly configured modular interlocking mold form thereabove and therebelow.

A spacer mid-section will be fixedly secured to the first flange and to the second flange for maintaining them in spaced relation with respect to one another and for maintaining the first panel member and the second panel member spaced apart from one another to define the molding chamber between the inner sides thereof. The spacer mid-section will extend generally perpendicularly to the first panel member and to the second panel member.

The first and second panel members will preferably include first and second tab means extending therefrom and preferably on the upper ends thereof. These panels will also preferably include interlocking grooves on the lower portion thereof such that the tabs from modular interlocking mold forms can interlock with the grooves of similar modular forms positioned thereabove for maintaining the integrity and vertical orientation of the mold forms prior to pouring of unhardened concrete thereinto.

In forming of the concrete wall construction initially the panel members will be formed within a mold of a conventional injection molding process preferably from a foam polymeric material. The first and second panel members will both preferably be of identical configuration and preferably will be formed from the same mold. At the same time a plurality of connecting members can be formed having a spacer mid-section and first and second oppositely positioned flanges thereon. Multiple connecting members as well as multiple panel members can then be shipped to the site where the wall is desired to be constructed. At that location the connecting member can be placed in engagement with two panel members for maintaining the panel members spaced from one another to define the concrete mold therebetween. Preferably this interconnection is achieved by positioning the first flange of the connecting member within a first slot defined in the first panel member while at the same time positioning the second flange of a connecting member into the second slot defined in a second panel. In this manner the lateral width of the spacer mid-section of the connecting member will maintain the first and second panels in spaced relation from one another such that the inner surfaces thereof define the concrete mold form therebetween. Preferably this concrete mold form will form multiple horizontal and vertically extending columns in such a manner as to provide an overall final wall strength of the wall section of significant strength. With such a configuration the actual size of the concrete wall and the width of the wall can be varied by choosing connecting members of various sizes with the spacer midsections thereof being of different horizontal widths. For example, if a connecting member is chosen with a spacer mid-section of a six inch lateral dimension, the wall will be one-half as thick as if connecting members are chosen for the construction wherein the spacer mid-section is of a twelve inch horizontal mid-section.

At the site where the construction of the wall is desired the first and second panel will be spaced from one another and the connecting members will be secured thereto by positioning of the respective first and second flanges thereof in the first and second slots of the panel members. At this point the molding chamber therebetween will be defined and unhardened concrete can be poured therein. This unhardened concrete is now allowed to dry within the molding chamber to form the modular wall construction unit comprising the composite configuration of the hardened concrete, the foam polymeric first and second panel members as well as the connecting members therein. With this final construction the vertically extending flanges on both sides of the wall will provide areas for connectors to be interjected through the wall at laterally spaced distances of approximately twelve inches.

In the preferred configuration the flanges will extend vertically through the entire vertical length of the vertical slots defined in the first and second panel members and will be capable of abutment with respect to a similar flange positioned in a similar modular unit located thereabove. In this manner the vertically extending securement surfaces will be spaced laterally at twelve inches and will also extend vertically along the entire length of the wall.

It is an object of the present invention to provide an improved method and apparatus for forming of poured concrete walls wherein panels are formed of an expandable polymer such as polystyrene.

It is an object of the present invention to provide an improved method and apparatus for forming of poured concrete walls wherein initial capital costs are minimized.

It is an object of the present invention to provide an improved method and apparatus for forming of poured concrete walls wherein maintenance costs are minimized.

It is an object of the present invention to provide an improved method and apparatus for forming of poured concrete walls wherein the overall strength of the wall configuration is significantly enhanced.

It is an object of the present invention to provide an improved method and apparatus for forming of poured concrete walls wherein strengthening rods known as "rebars"can extend vertically and horizontally through the concrete columns for reinforcement thereof.

It is an object of the present invention to provide an improved method and apparatus for forming of poured concrete walls wherein multiple modular interlocking mold forms stack vertically and horizontally to form a wall of any size.

It is an object of the present invention to provide an improved method and apparatus for forming of poured concrete walls wherein securement surfaces on the wall area are provided on twelve inch centers.

It is an object of the present invention to provide an improved method and apparatus for forming of poured concrete walls wherein the spreader bracket or connecting member is removable with respect to the panel members on each side thereof to facilitate collapsing of the poured concrete mold form to facilitate shipment, storage and use.

It is an object of the present invention to provide an improved method and apparatus for forming of poured concrete walls wherein the connecting members are disassembled from the first and second panel members prior to interconnection thereof at the construction site where the vertical wall is to be formed.

It is an object of the present invention to provide an improved method and apparatus for forming of poured concrete walls wherein it is not necessary to secure the connecting member to the first and second panels during mold forming of the panels.

It is an object of the present invention to provide an improved method and apparatus for forming of poured concrete walls wherein securement surfaces extend along the entire vertical length of a formed wall section at twelve inch intervals.

It is an object of the present invention to provide an improved method and apparatus for forming of poured concrete walls wherein interlocking between adjacently positioned connecting members of adjacently positioned mold forms is not necessary and mere abutment will suffice.

It is an object of the present invention to provide an improved method and apparatus for forming of poured concrete walls wherein the connecting members can be formed of steel or plastic or any other material.

It is an object of the present invention to provide an improved method and apparatus for forming of poured concrete walls wherein the panel members are preferably formed of a foam polymer material such as to be fire resistant.

It is an object of the present invention to provide an improved method and apparatus for forming of poured concrete walls wherein the connecting members can be formed as solid or perforated members.

It is an object of the present invention to provide an improved method and apparatus for forming of poured concrete walls wherein connecting members of various lateral dimensions can be used to allow the construction team at the site of construction of the wall to determine the wall thickness to be utilized in the specific application.

It is an object of the present invention to provide an improved method and apparatus for forming of poured concrete walls wherein a single panel member can be universally provided to form both the left and/or right as well as the first and/or second panel member configuration.

It is an object of the present invention to provide an improved method and apparatus for forming of poured concrete walls wherein the mold form can be constructed with the connecting members positioned within the slots of the first and second panels by friction fitting or by being fastened therein with a high strength adhesive.

It is an object of the present invention to provide an improved method and apparatus for forming of poured concrete walls wherein insert molding of the first and second panels is no longer needed thereby eliminating the inherent danger associated therewith.

It is an object of the present invention to provide an improved method and apparatus for forming of poured concrete walls wherein corners can be configured to provide a securement surface thereon utilizing perpendicular flange sections.

It is an object of the present invention to provide an improved method and apparatus for forming of poured concrete walls wherein a poured concrete fire wall is provided to enhance fire resistance of buildings.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
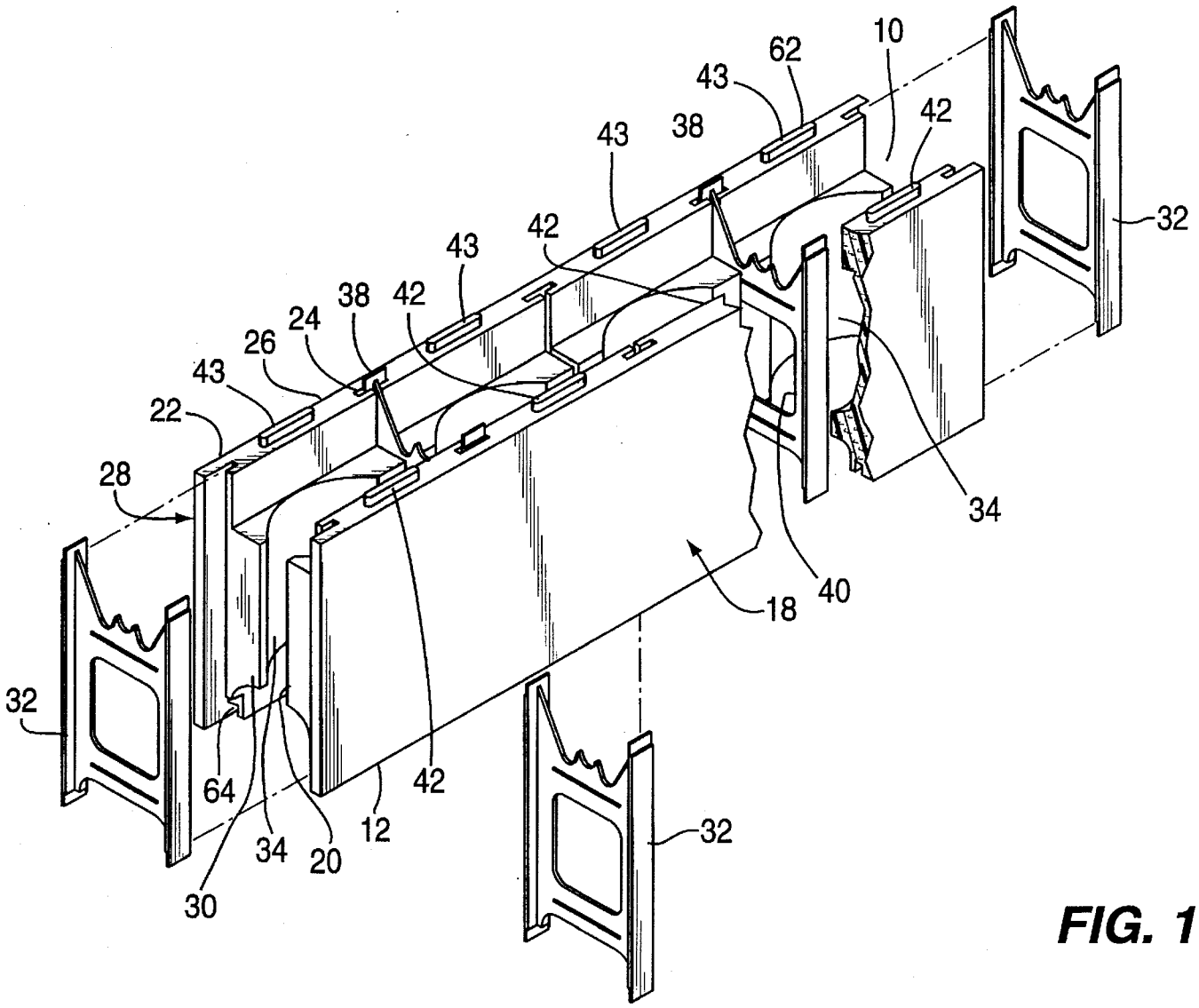
FIG. 1 is a perspective illustration of an embodiment of a modular interlocking mold form for use with the present invention.

The present invention provides a concrete wall forming apparatus along with a method for forming of a concrete wall therewith. The design of the present invention forms a poured concrete wall composite construction 10 formed of a first panel member 12, a second panel member 22, connecting members 32 extending therebetween along with poured concrete placed therebetween.

The first panel member 12 preferably is formed of a foam polymeric material and includes a first slot 14 extending vertically preferably through the entire vertical distance thereof. This first panel member 12 defines a first outer panel side 16 having a first wall surface area 18 defined thereon and a first inner panel side 20 positioned oppositely on the first panel member 12 from the first outer panel side 16.

Preferably the second panel member 22 is also formed of a foam polymeric material and is of an identical configuration to the first panel member 12. Preferably the second panel member 22 can actually be an interchangeable part with the configuration which forms the first panel member 12. However for definition purposes, the second panel member 22 defines a second slot 24 extending vertically preferably through the entire length thereof. The second panel member 22 also preferably defines a second outer panel 26 which includes a second wall surface area 28 thereon. Second panel member 22 preferably also includes a second inner panel side 30 positioned oppositely from the second outer panel side 26.

The connecting members 32 extend between the first panel member 12 and the second panel member 22 with the inner sides 20 and 30 thereof facing one another and facing the connecting members 32. Preferably the connecting members 32 are formed with a first flange 36 and a second flange 38 thereon along with a spacer mid-section 40. The spacer mid-section 40 preferably includes the first flange 36 fixedly secured at one end thereto and a second flange 38 fixedly secured at the opposite end thereto. Preferably the first and second flanges 36 and 38 are integral with respect to the spacer mid-section 40.

The first flange 36 is designed to be detachably positionable within the first slot 14 of the first panel member 12 to be detachably securable thereto. In a similar manner the second flange 38 is designed to be detachably securable extending into the second slot 24 of the second panel member 22 to be detachably securable with respect thereto. With the first flange 36 in engagement with the first slot 14 and the second flange 38 in engagement with the second slot 24 the connecting member 32 will be fixedly secured to the first panel member 12 and the second panel member 22 for holding thereof in spaced relationship with respect to one another to define therebetween a molding chamber 34. Molding chamber 34 will be adapted to receive non-hardened poured concrete therein such as to provide a mold therefore for facilitating erection of a poured concrete wall construction.

With the configuration of the present invention wherein the first panel 12 and the second panel 22 being of an identical configuration they are virtually interchangeable parts and preferably are shipped to the construction site along with a supply of connecting members 32 in collapsed form. At the construction site the connecting members 32 can have the first and second flanges 36 and 38 thereof positioned within the slots 14 and 24 of the first and second panel members 12 and 22 to erect the poured concrete wall mold form thereby defining the molding chamber 34 between the panel members and allowing placement of non-hardened mixed concrete therebetween for final forming of the poured concrete wall composite construction 10.

Figure 2:
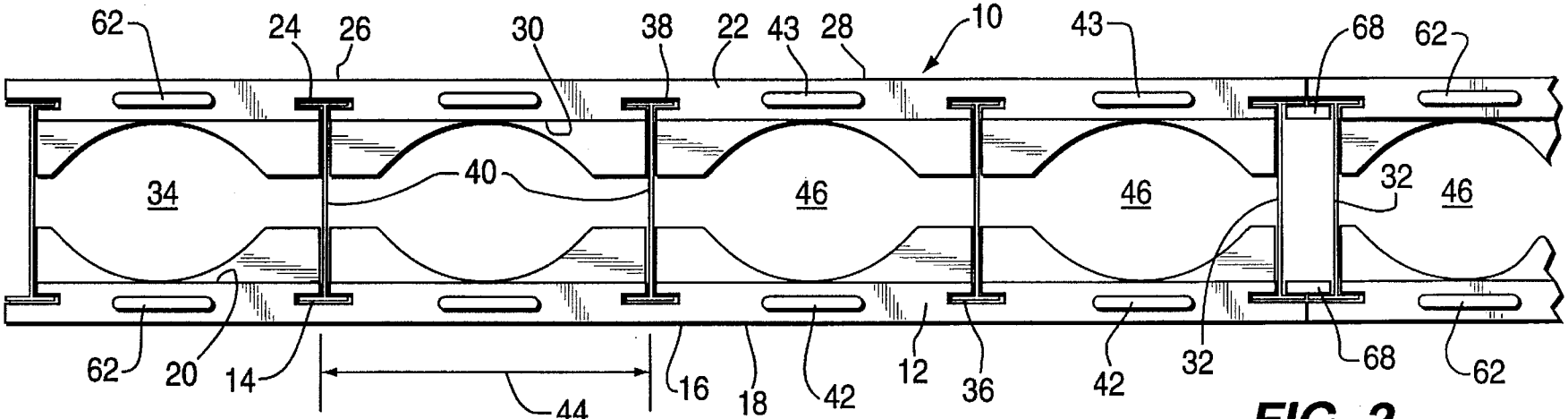
FIG. 2 is a top plan view of an embodiment of the configuration shown in FIG. 1.
Figure 3:
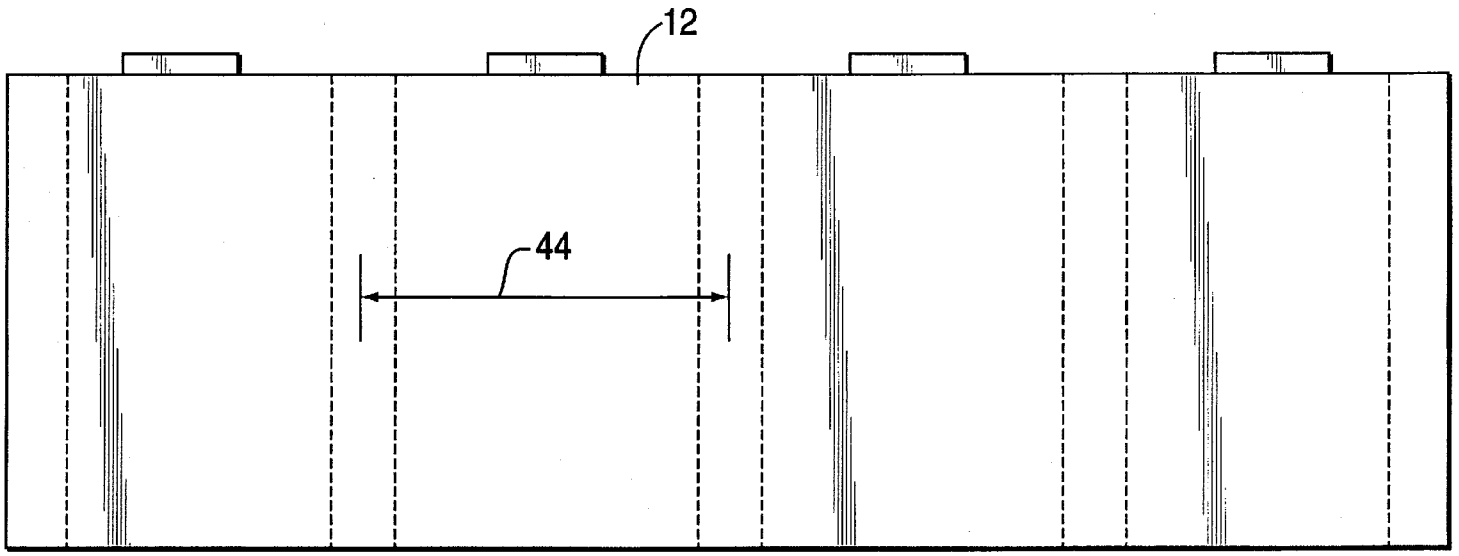
FIG. 3 is a front plan view of the embodiment shown in FIG. 1.
Figure 4:
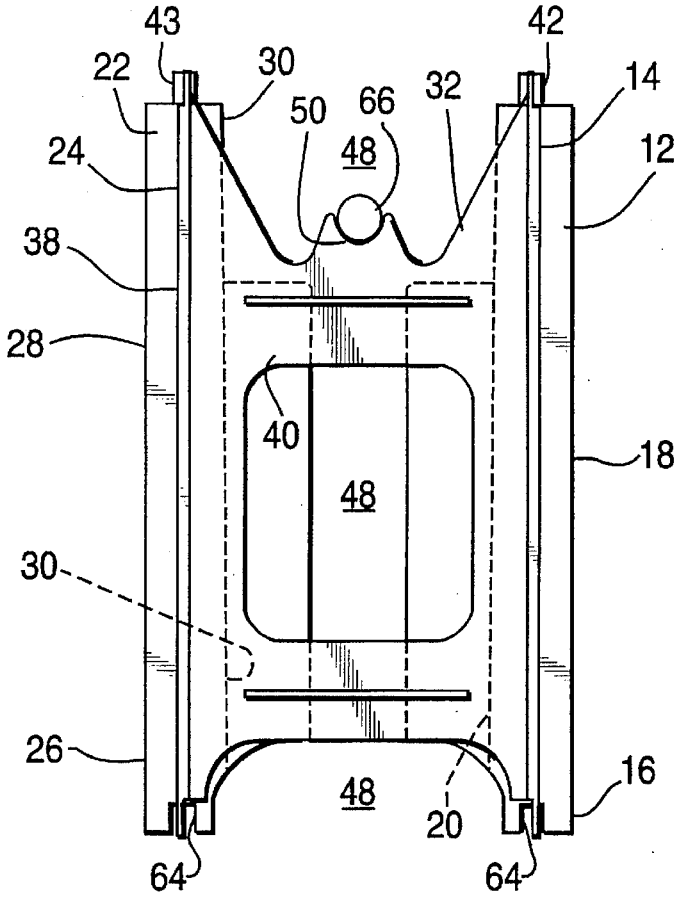
FIG. 4 is a sectional view of the embodiment shown in FIG. 1.

In the preferred configuration multiple modular interlocking mold forms 60 will be utilized. Preferably each of the first panel members 12 and the second panel members 22 will include interlocking tabs 62 extending vertically therefrom and will define interlocking grooves 64 in the undersurface thereof. In this manner the modular interlocking mold forms 60 can be stacked vertically with the interlocking tabs 62 extending into the interlocking grooves 64 for engaging between vertically adjacent modular interlocking mold forms. In a similar manner the modular interlocking mold form 60 can be positionable in abutment with respect to adjacent similar configurations as shown best in FIG. 2. In this abutting configuration it has been found preferable to position inserts 68 preferably of a foam material behind the two adjacently positioned flanges to facilitate use of these flanges as securement studs extending vertically along the wall surface. Preferably these flanges will be spaced vertically at wwelve inch spacing intervals 44 as also shown in FIG. 2. The interlocking tabs 62 and the interlocking grooves 64 associated with the first panel member 12 will preferably be securable with respect to one another to provide the ability to form a wall of any lateral or vertical size.

In order to achieve a significantly strong concrete molding form preferably the first inner panel side 20 and the second inner panel side 30 will define vertically extending concrete columns 46. These columns will be formed when poured concrete extends into the concrete forming column mold areas 46. In a similar manner horizontally extending columns 48 will preferably be defined by the first inner panel sides 20 and the second inner panel sides 30 to define a horizontally extending concrete column form for forming horizontal concrete columns 48 when poured concrete is placed therein. For further strengthening thereof in a manner conventional with concrete construction steel bars can extend through these concrete column areas. To facilitate placement of such bars the connecting members 32 can define a reinforcing bar cradle 50 which is adapted to receive a reinforcing bar 66 positioned therein prior to placement of poured concrete therein and hardening thereof in order to further strengthen the horizontally extending columns. Similar reinforcing bars 66 can be used with the vertically extending columns.

Figure 5:
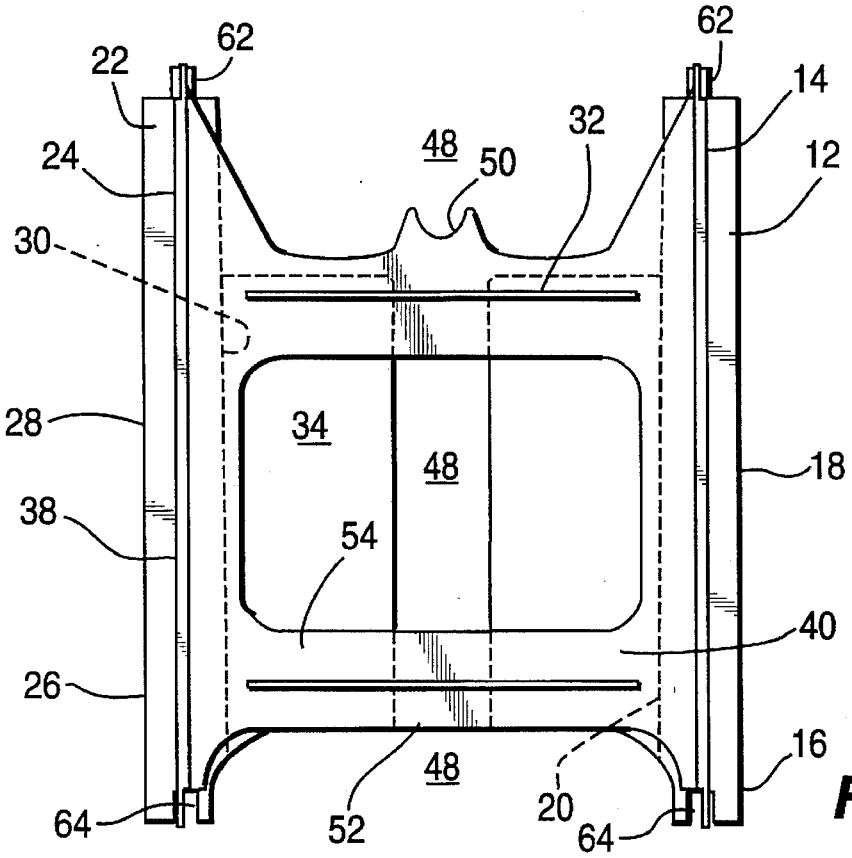
FIG. 5 is a sectional view similar to FIG. 4 however showing an alternative configuration for the connecting member having a wider spacing for forming of a thicker concrete wall.
Figure 7:
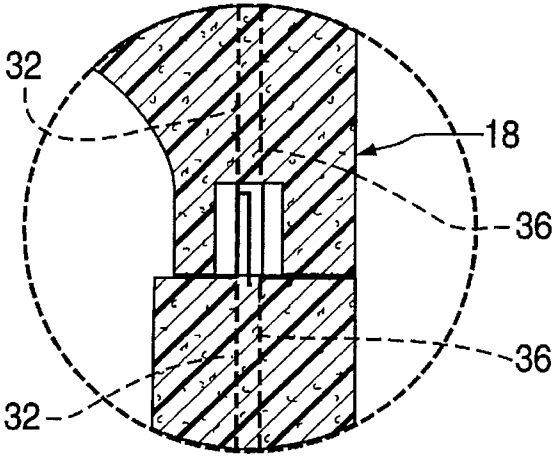
FIG. 7 is an expanded view of area 7—7 of FIG. 6.

One of the unique advantages of the present invention is in the fact that the first and second panels 12 and 22 as well as the connecting members 32 can be shipped to the construction site in collapsed form. Since the first and second panels are preferably of identical configuration there is no left or right or specific configuration for the first or second panel. Once they are on site then the connecting members 32 can be secured between two such identical panels thereby forming the modular interlocking mold form 60. Certain construction parameters would require that different thicknesses of wall be utilized in different applications. For this purpose alternate connecting members 52 are provided which have various choices of size between the spacing of the flanges 36 and 38 thereof. This variation in spacing is achieved by the varying the lateral dimension of the spacer mid-section 40. Thus, a wall configuration could be formed of six, twelve or eighteen inches or any dimension chosen based upon the lateral dimension of the connecting member 32. These are provided by different distances in the alternate spacer mid-section 54 as shown in FIG. 5.

Figure 8:
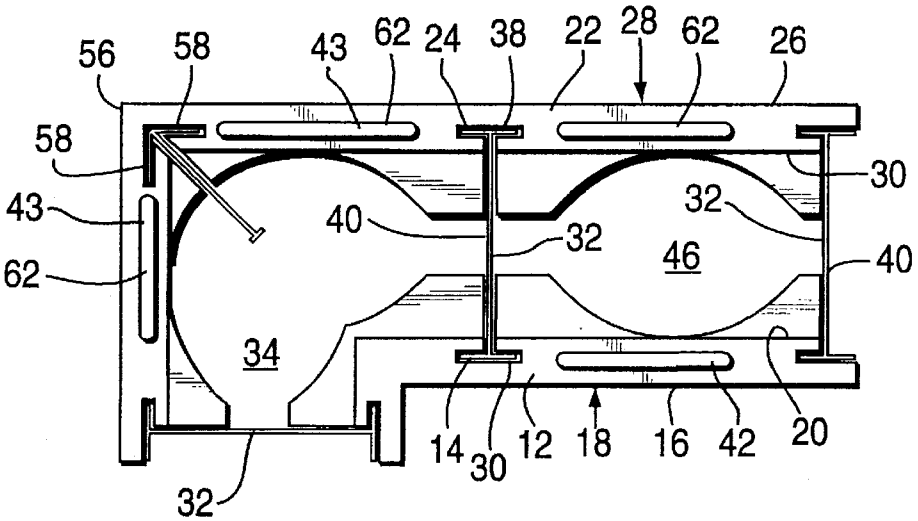
FIG. 8 is a top plan view of the embodiment of the modular interlocking mold form corner configuration.
Figure 6:
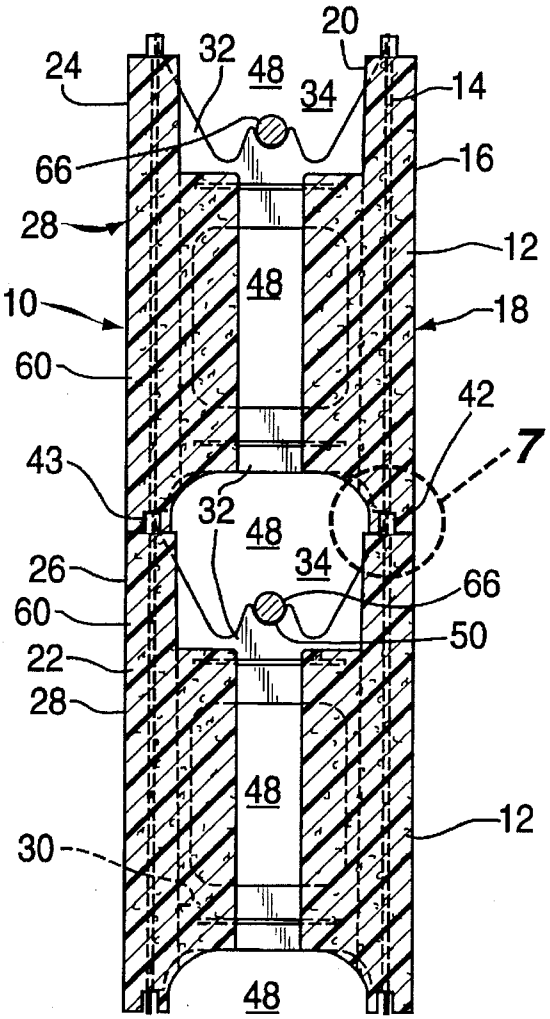
FIG. 6 is a side plan view showing two embodiments of the modular interlocking mold forms positioned vertically above one another.

The apparatus of the present invention is also particularly useful for forming exterior corners 56 as shown best in FIG. 8. In this configuration a corner spline 56 configuration for the connecting member 32 can be utilized wherein perpendicular flange sections 58 are utilized. The rear portion of the corner spline 56 is not designed to be secured with respect to the inner wall but merely provides the vertically extending steel or plastic member beneath the polymeric foam of the exterior panel to allow nailing directing into the wall without the normal resistance which would be incurred by contacting the poured hardened concrete therebelow.

One of the unique advantages of the design of the present invention is in the ability to simulate standard wooden construction. Within standard wooden construction vertical wooden studs are positioned at regular intervals to allow nails or other affixing devices to penetrate the wall for securement to the more secure studs. The present invention simulates such studs by positioning the vertically extending flanges 36 and 38 at regular twelve inch spacing intervals 44. Preferably with the flanges extending through the entire vertical length of each panel member 12 and 22 and being capable of abutting adjacent flanges being thereabove or therebelow, the securement surface will be provided along the twelve inch centers along the entire vertical length of the wall regardless of how many individual poured concrete wall composite construction modular sections are included.

In prior art designs the modular interlocking mold form 60 is constructed prior to shipment. In fact the panels are formed of a polymeric foam material by the insert molding process wherein the spacers or spreaders for maintaining the foam vertical panels at a spaced distance are affixed to the vertical panels at the time of molding of the vertical panels themselves. During this conventional molding process the spacers or spreaders are captured thereby forming a composite construction which must be shipped to the job site which tends to be rather bulky. The present invention provides a unique means for allowing assembly of this modular construction unit at the job site wherein the two opposite panel sections are molded separately and are of identical configuration and wherein the connecting members 32 include flanges 36 and 38 which are detachably securable within slots defined in the panel members. In this manner great savings are achieved in shipment costs, storage and inventory requirements.

Once the connecting members 32 are positioned within the slots in the panel members 12 and 22 they can be adhesively secured therein if desired since the final construction has been achieved prior to pouring of the unhardened concrete.

The design of the present invention avoids the necessity of utilizing a complicated and dangerous insert molding process wherein spreaders or spacers are required to be positioned within the foam molds which form the two opposite vertical panel members at the time of forming thereof by the injection foam molding process.

In convention wall design used heretofore, wooden studs are available at lateral intervals of 12 or 16 or 24 inches into which nails or other securement devices can be attached. With the design of the present invention the foam polymeric material does not provide sufficient support for holding a driven nail and the hardened concrete is usually too hard to receive such a nail. Thus, the first flanges 36 and the second flanges 38 which extending vertically provide, respectively, the first engagement means 42 and the second engagement means 43. These engagement means 42 and 43 will be immediately below the foam polymer exterior wall surface and will be laterally spaced at preferably twelve inch intervals. The flanges 36 and 38 will provide these engagement means 42 and 43 regardless of whether they are formed of a plastic or metal material since both will receive and retain driven nails, screws or other wall attachments and thereby provide conventional engagement means at twelve inch intervals.

It should be appreciated that the connecting members of the present invention can be formed of plastic or metal or any chosen material and only need be strong enough to retain the vertical panels 12 and 22 in their desired orientation when the poured concrete is placed into the molding area defined therebetween.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

We claim:

1. A concrete wall forming apparatus defining a mold for forming a wall by receiving poured concrete therein, the apparatus comprising:

A. a first panel member defining a first slot means extending vertically therethrough, said first slot means including at least one L-shaped first slot, said first panel member including:

(1) a first outer panel side including a first wall surface area extending generally vertically thereon, said first outer panel side including an exterior corner thereon;

(2) a first inner panel side positioned oppositely from said first outer panel side;

B. a second panel member defining a second slot means extending vertically therethrough, said second panel member including:

(1) a second outer panel side including a second wall surface area extending generally vertically thereon and facing oppositely from said first panel member;

(2) a second inner panel side positioned oppositely from said second outer panel side and facing said first inner panel side of said first panel member;

C. a connecting member means detachable securable with respect to said first panel member and said second panel member and extending therebetween to maintain a spatial distance therebetween for defining a molding chamber means therebetween, said connecting member means including at least one connecting member comprising:

(1) a first flange means detachably securably extending within said first slot means of said first panel member, said first flange means including two flange sections thereon oriented perpendicular to one another to facilitate detachable securement of said first flange means within said L-shaped slot;

(2) a second flange means detachably securably extending within said second slot means of said second panel member; and (3) a spacer mid-section means fixedly secured to said first flange means and said second flange means for maintaining them in spaced relation with respect to one another and for maintaining said first panel member and said second panel means spaced apart from one another to define said molding chamber means between said first inner panel side and said second inner panel side thereof, respectively.

2. A concrete wall forming apparatus defining a mold for forming a wall by receiving poured concrete therein, as defined in claim 1 wherein said first panel member and said second panel member are identical in shape and configuration and are completely interchangeable.

3. A concrete wall forming apparatus defining a mold for forming a wall by receiving poured concrete therein, as defined in claim 1 wherein said spacer mid-section extends approximately perpendicular with respect to said first wall surface area and said second wall surface area.

4. A concrete wall forming apparatus defining a mold for forming a wall by receiving poured concrete therein, as defined in claim 1 wherein said first slot means extends vertically through said first panel member completely and wherein said first flange means extends completely through said first slot means to define an first engagement means vertically therealong within said first panel member.

5. A concrete wall forming apparatus defining a mold for forming a wall by receiving poured concrete therein, as defined in claim 1 wherein said second slot means extends vertically through said second panel member completely and wherein said second flange means extends completely through said second slot means to define an second engagement means vertically therealong within said second panel member.

6. A concrete wall forming apparatus defining a mold for forming a wall by receiving poured concrete therein, as defined in claim 1 wherein said first panel member and said second panel member are formed of foam polymeric material.

7. A concrete wall forming apparatus defining a mold for forming a wall by receiving poured concrete therein, as defined in claim 1 wherein said connecting members are formed of steel.

8. A concrete wall forming apparatus defining a mold for forming a wall by receiving poured concrete therein, as defined in claim 1 wherein said connecting members are formed of plastic.

9. A concrete wall forming apparatus defining a mold for forming a wall by receiving poured concrete therein, as defined in claim 1 wherein said connecting members are positioned along said first panel members and said second panel members at positions spaced approximately twelve inches apart laterally therealong.

10. A concrete wall forming apparatus defining a mold for forming a wall by receiving poured concrete therein, as defined in claim 1 wherein said first inner panel side and said second inner panel side define a plurality of vertically extending concrete column mold forms and a plurality of horizontally extending concrete column mold forms to facilitate strengthening of the formed concrete wall.

11. A concrete wall forming apparatus defining a mold for forming a wall by receiving poured concrete therein, as defined in claim 1 wherein said spacer mid-section means of said connecting member defines a re-enforcing bar cradle means adapted to receive a re-enforcing means therein prior to pouring of the concrete to facilitate strengthening thereof.

12. A concrete wall forming apparatus defining a mold for forming a wall by receiving poured concrete therein, as defined in claim 1 further comprising alternate connecting members each including alternate spacer mid-section means of a different lateral size than said spacer mid-section means.

13. A concrete wall forming apparatus including a plurality of modular interlocking mold forms each defining a mold for forming a wall by receiving poured concrete therein, each said modular interlocking mold form comprising:

A. a first panel member of foam polymeric material defining a first slot means extending vertically completely therethrough, said first slot means comprising first vertical slots positioned therein with spacing therebetween of approximately twelve inches, said first slot means including at least one L-shaped first slot, said first panel member including:

(1) a first outer panel side including a first wall surface area extending generally vertically thereon, said first outer panel side including an exterior corner thereon;

(2) a first inner panel side positioned oppositely from said first outer panel side;

B. a second panel member of foam polymeric material of the same configuration as said first panel member and defining a second slot means extending vertically completely therethrough, said second slot means comprising second vertical slots positioned therein with spacing therebetween of approximately twelve inches, said second panel member including:

(1) a second outer panel side including a second wall surface area extending generally vertically thereon and facing oppositely from said first panel member;

(2) a second inner panel side positioned oppositely from said second outer panel side and facing said first inner panel side of said first panel member, said first inner panel side and said second inner panel side define a plurality of vertically extending concrete column mold forms and a plurality of horizontally extending concrete column mold forms to facilitate strengthening of the formed concrete wall;

C. a connecting member means detachable securable with respect to said first panel member and said second panel member and extending therebetween to maintain a spatial distance therebetween for defining a molding chamber means therebetween, said connecting member means including at least one connecting member comprising:

(1) a first flange means detachably securably extending within said first slot means of said first panel member, said first flange means extending through the entire length of said first slot means to be capable of abutment with a flange means of a similarly configured modular interlocking mold form thereabove and therebelow, said first flange means further including two flange sections thereon oriented perpendicular to one another to facilitate detachable securement of said first flange means within said L-shaped slot, said first flange means providing a first engagement means continuously vertically along said first panel member;

(2) a second flange means detachably securably extending within said second slot means of said second panel member, said second flange means extending through the entire length of said second slot means to be capable of abutment with a flange means of a similarly configured modular interlocking mold form thereabove and therebelow, said second flange means providing a second engagement means continuously vertically along said second panel member; and (3) a spacer mid-section means fixedly secured to said first flange means and said second flange means for maintaining them in spaced relation with respect to one another and for maintaining said first panel member and said second panel means spaced apart from one another to define said molding chamber means between said first inner panel side and said second inner panel side thereof, said spacer mid-section extending generally perpendicular to said first panel member and said second panel member respectively.

* * * * *